US011839000B1

(12) United States Patent
Savla

(10) Patent No.: US 11,839,000 B1
(45) Date of Patent: Dec. 5, 2023

(54) LIGHT DIMMER FOR NON-DIMMABLE LED LIGHT BULBS

(71) Applicant: Lalit J Savla, San Diego, CA (US)

(72) Inventor: Lalit J Savla, San Diego, CA (US)

( * ) Notice: Subject to any disclaimer, the term of this patent is extended or adjusted under 35 U.S.C. 154(b) by 0 days.

(21) Appl. No.: 18/236,274

(22) Filed: Aug. 21, 2023

Related U.S. Application Data

(60) Provisional application No. 63/400,585, filed on Aug. 24, 2022.

(51) Int. Cl.
*H05B 45/10* (2020.01)
*H05B 47/11* (2020.01)

(52) U.S. Cl.
CPC ..... *H05B 45/10* (2020.01); *H05B 47/11* (2020.01)

(58) Field of Classification Search
CPC .... H05B 41/16; H05B 41/24; H05B 41/2821; H05B 45/10; H05B 47/11; H01J 61/56; H02M 1/0032; H02M 1/0045; H02M 1/007; H02M 1/32; H02M 3/33538
See application file for complete search history.

(56) References Cited

U.S. PATENT DOCUMENTS

2005/0029872 A1* 2/2005 Ehrman ..... H02M 1/32 307/11
2017/0279368 A1* 9/2017 Barbosa ..... H02M 7/062

* cited by examiner

*Primary Examiner* — Monica C King

(57) ABSTRACT

Non-dimmable LED light bulbs are less expensive than dimmable LED light bulbs and are "non-dimmable" by definition. This invention solves this problem, and it is possible to make a light dimmer that would dim non-dimmable LED light bulbs. Also, it can be used with dimmable LED light bulbs. The proposed dimmer will also extend the life of the LED light bulb since it does not use burst of high current pulses used in the PWM type dimmers. There is no power loss within the proposed dimmer circuit since it does not use any resistive or active components. The proposed invention can also be used to convert non-dimmable or dimmable LED light bulbs into reduced wattage light bulb which in turns saves energy, money and extends LED bulb life.

14 Claims, 13 Drawing Sheets

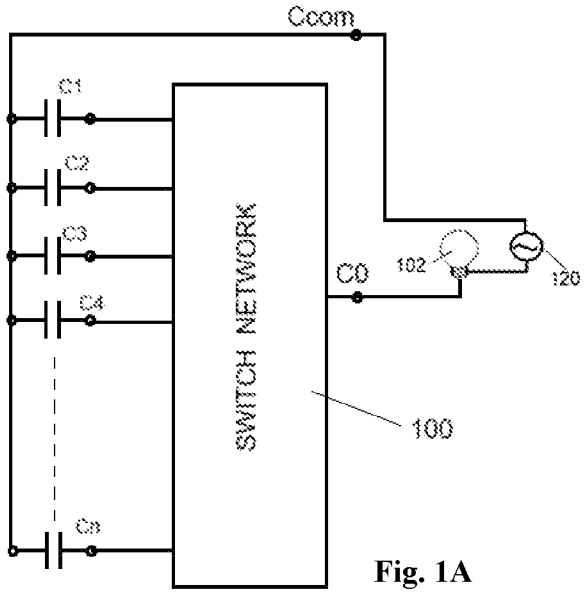
Fig. 1A
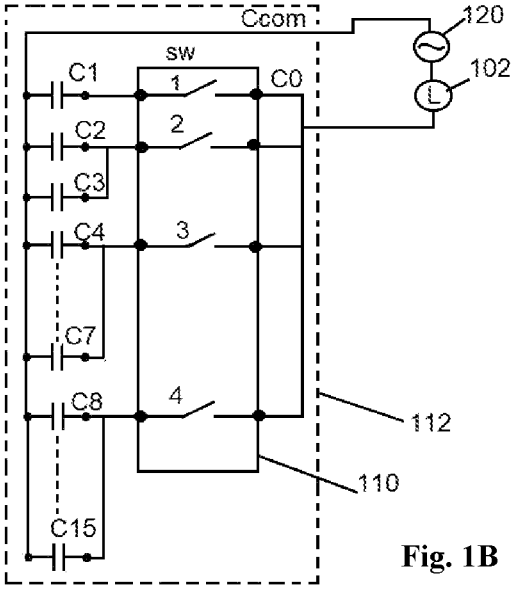
Fig. 1B
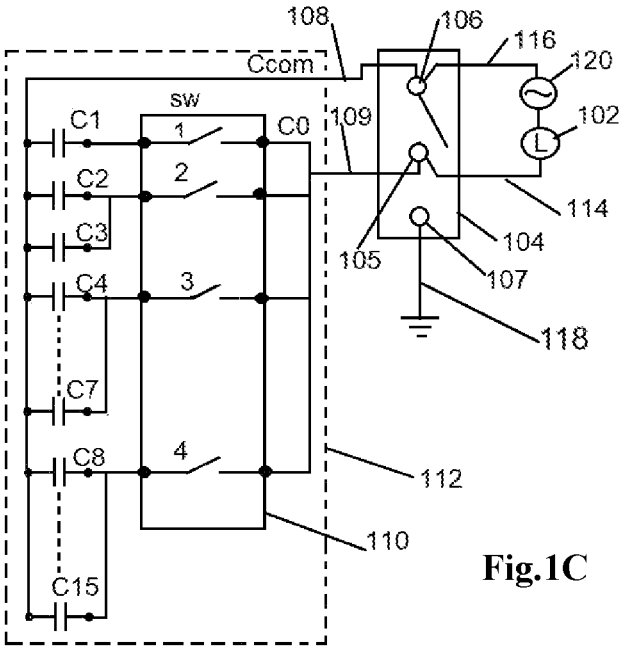
Fig.1C
Fig. 1

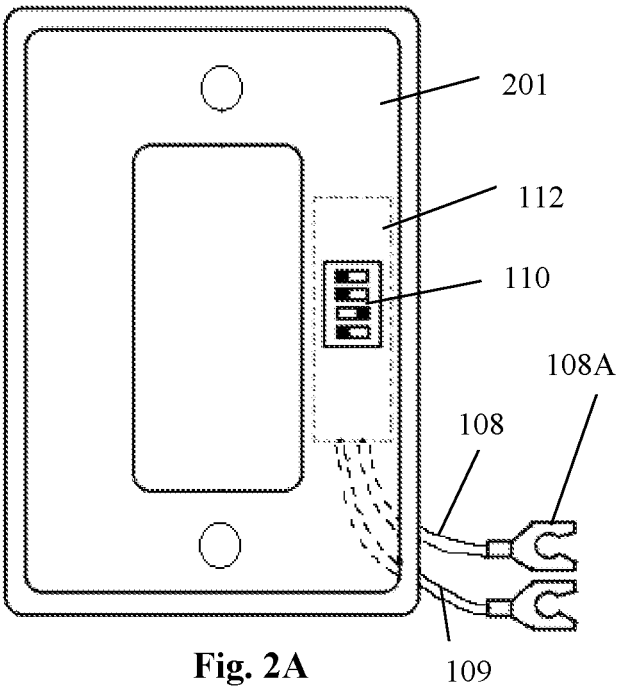
Fig. 2A
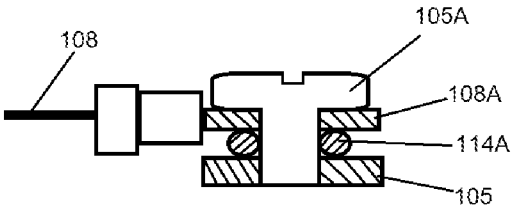
Fig. 2B
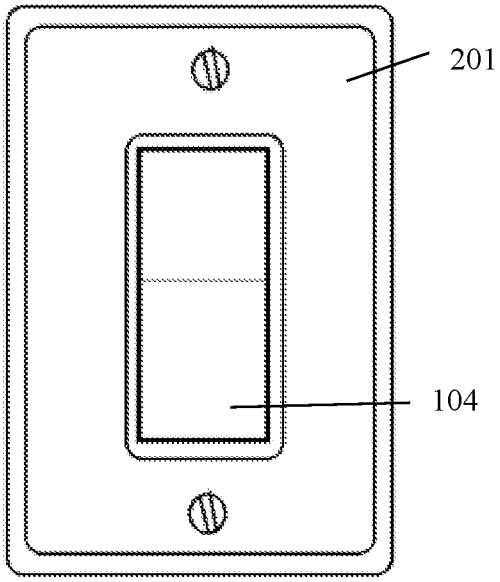
Fig. 2C
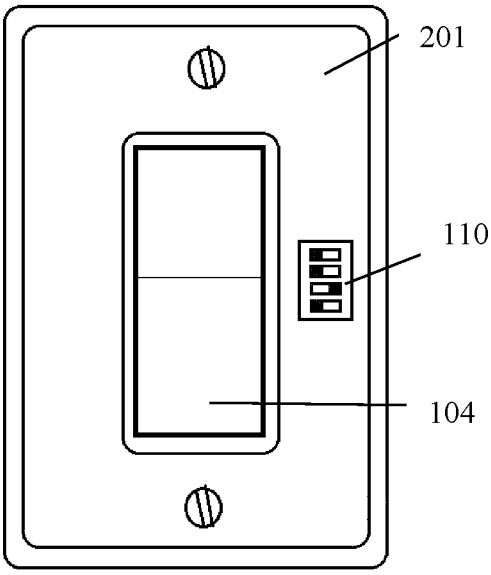
Fig. 2D
Fig. 2

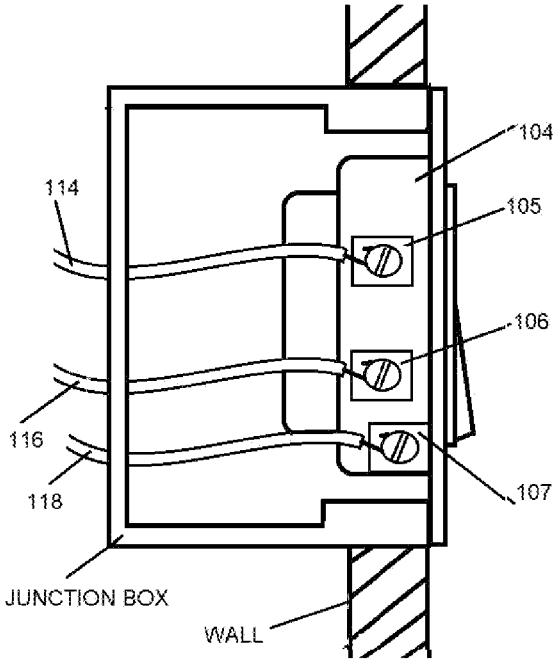
Fig 3A
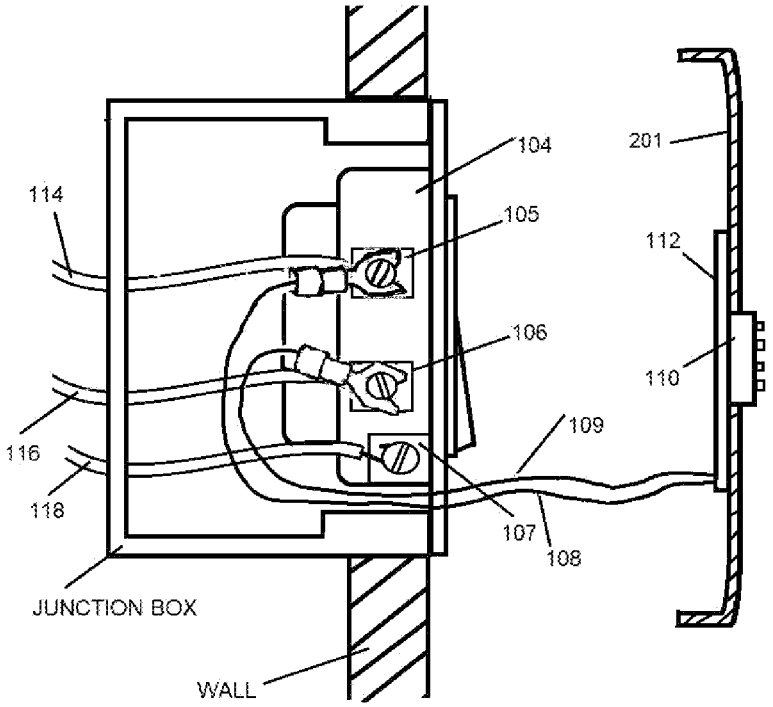
Fig 3B
Fig. 3

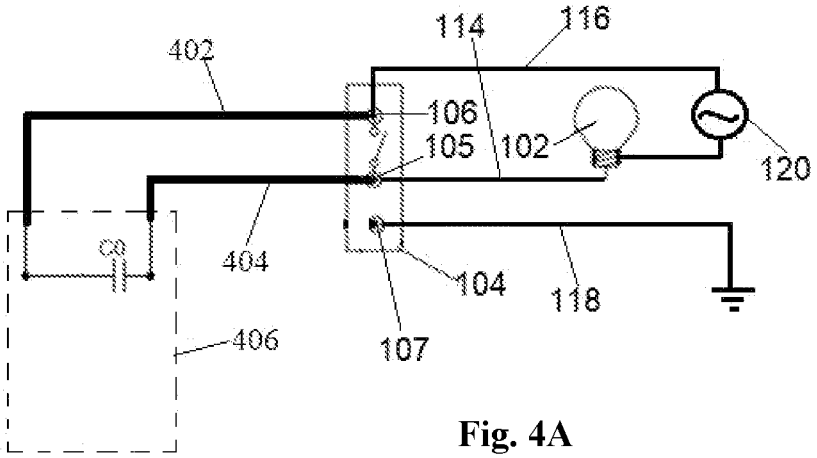
Fig. 4A
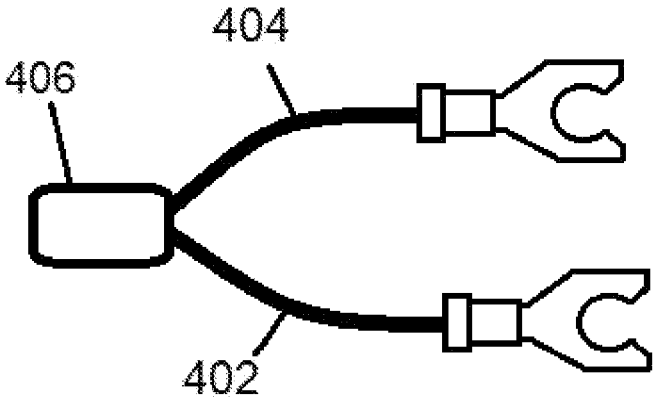
Fig. 4B
Fig. 4

Fig 7A
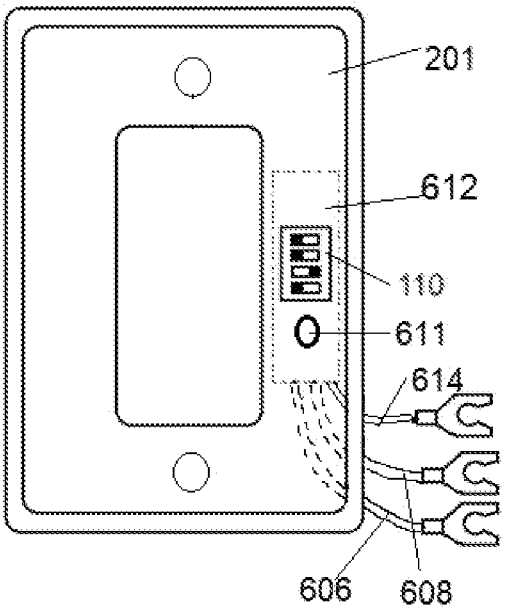
Fig. 7B
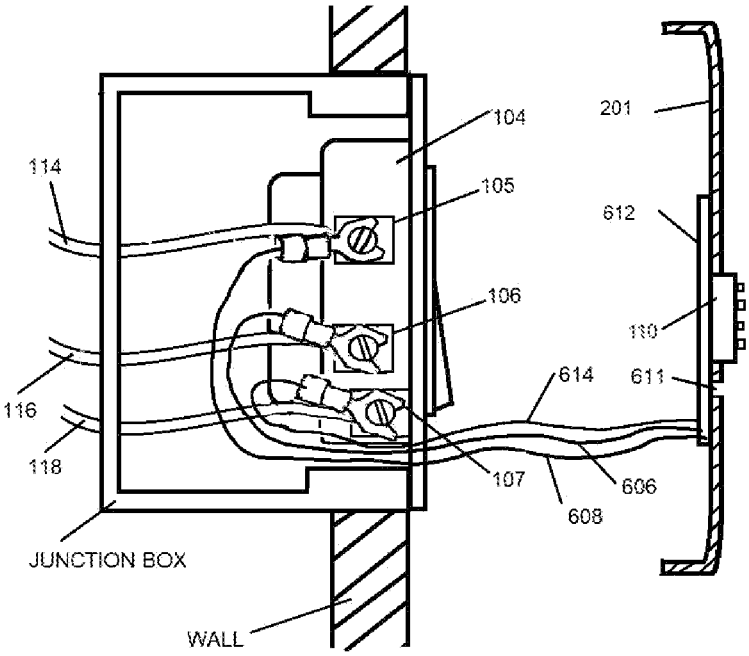
Fig. 7

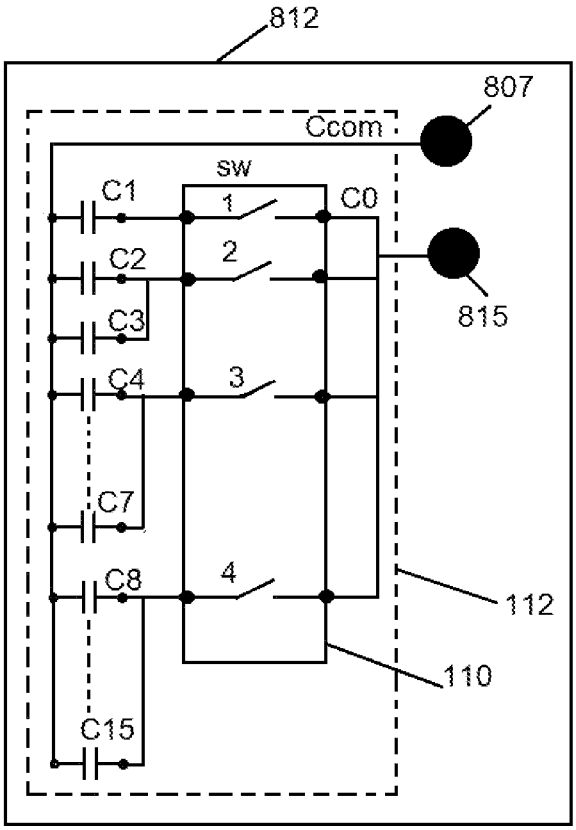
Fig. 8A
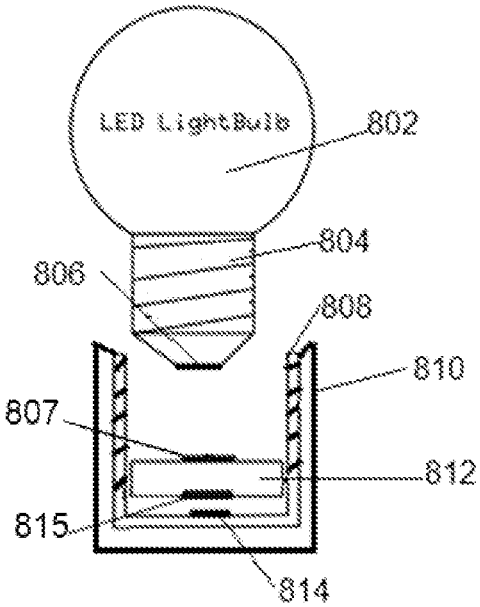
Fig. 8B
Fig. 8

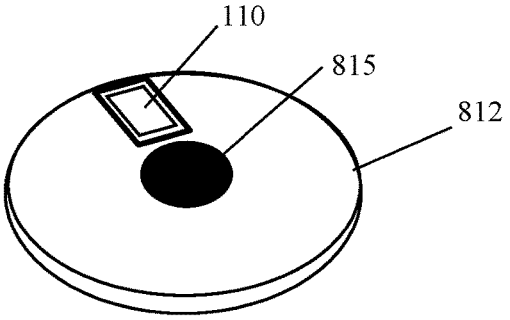
Fig. 9A
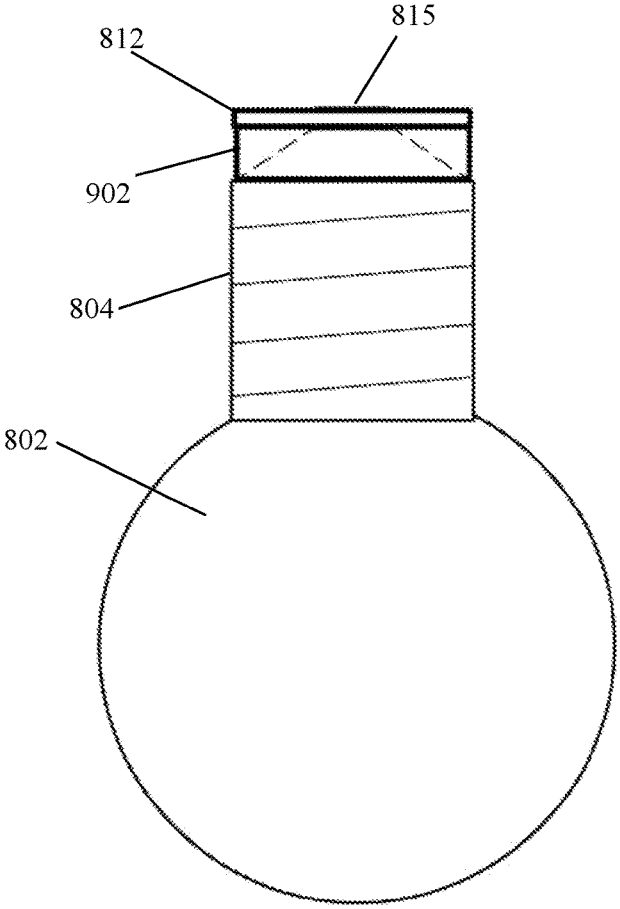
Fig. 9D
Fig. 9B
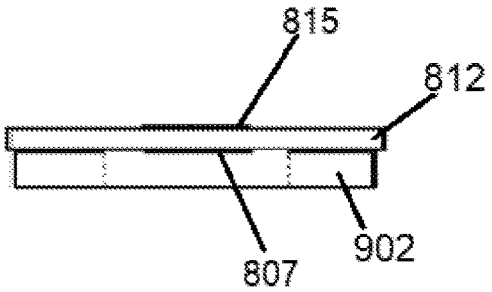
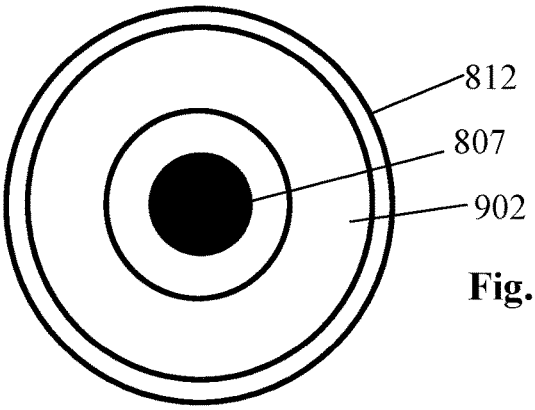
Fig. 9C
Fig. 9

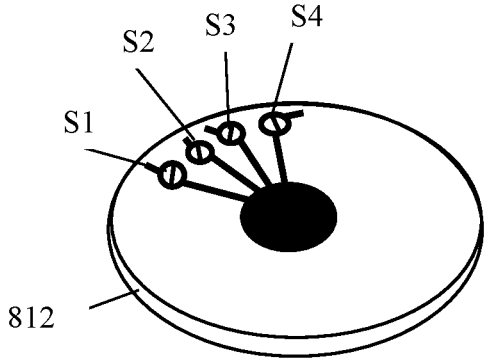
Fig. 10A
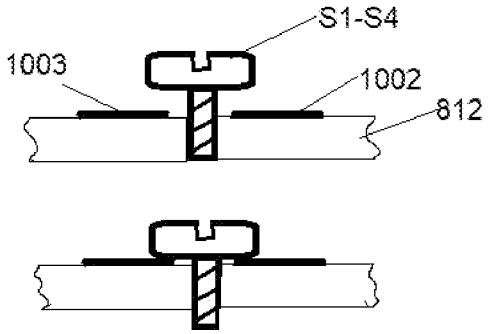
Fig. 10B
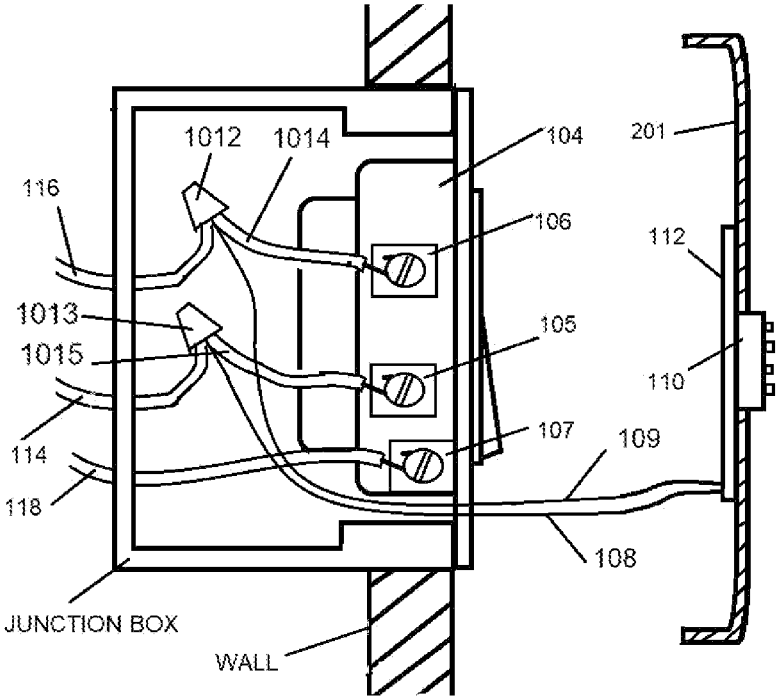
Fig. 10C
Fig. 10

TABLE 1

DIP switches positions and resulting C0 Cap Value (with C1-C15 =0.1uf)
Tested with Non Dimmable LED Light Bulb ( 9W Sunbeam brand)

| Decimal Value | SW1 | SW2 | SW3 | SW4 | C0 uf | Measured Bulb Brightness (Lux) | Measured Power Input (Watts) | | | | |
|---|---|---|---|---|---|---|---|---|---|---|---|
| 0 | Off | Off | Off | Off | 0 | 0 | 0 | | | | |
| 1 | Off | Off | Off | On | 0.1 | 59 | | | | | |
| 2 | Off | Off | On | off | 0.2 | 127 | | | | | |
| 3 | Off | Off | On | on | 0.3 | 202 | | | | | |
| 4 | Off | On | Off | Off | 0.4 | 270 | 0.4 | | | | |
| 5 | Off | On | Off | On | 0.5 | 336 | | | | | |
| 6 | Off | On | On | Off | 0.6 | 393 | | | | | |
| 7 | Off | On | On | On | 0.7 | 450 | | | | | |
| 8 | On | Off | Off | Off | 0.8 | 503 | 0.8 | | | | |
| 9 | On | Off | Off | On | 0.9 | 553 | | | | | |
| 10 | On | Off | On | Off | 1.0 | 598 | | | | | |
| 11 | On | Off | On | On | 1.1 | 642 | | | | | |
| 12 | On | On | Off | Off | 1.2 | 683 | | | | | |
| 13 | On | On | Off | On | 1.3 | 725 | | | | | |
| 14 | On | On | On | Off | 1.4 | 763 | | | | | |
| 15 | On | On | On | On | 1.5 | 802 | 1.4 | | | | |

Note: 1. Light Bulb Brightness measured approx. 15 inches from the bulb.

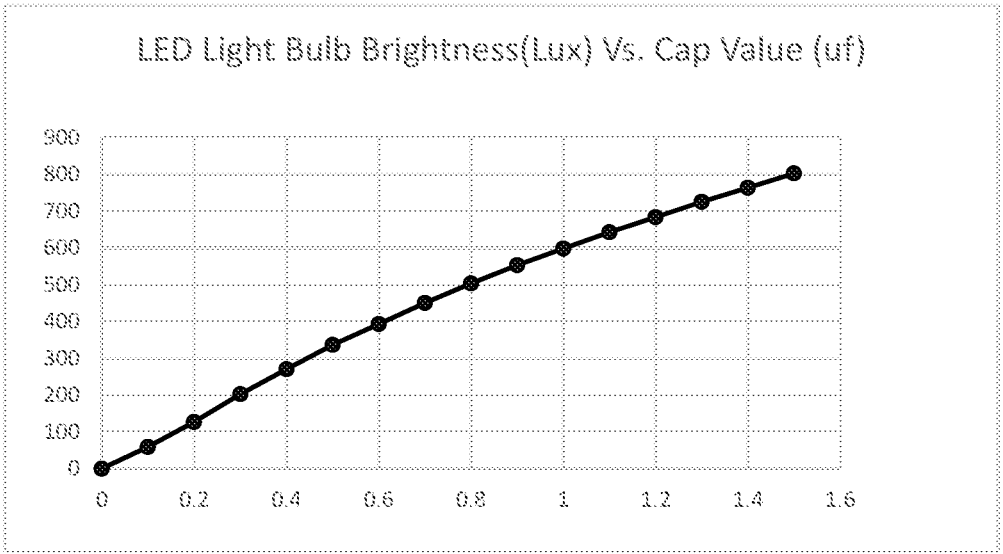

Fig. 11

| LED Bulb Brand | C0 uf | Xc=1/wc Ohms | Input Current, ma |
|---|---|---|---|
| Hullovota, Candle E12, 15W, non-dimmable | 0.2 | 13261 | 3.63 |
| Sunbeam 9W, non-dimmable | 0.1 | 26522 | 1.19 |
| Feit Filament 60w, 8.8W, non-dimmable | 0.2 | 13261 | 2.28 |
| Feit Ceiling BR30, 8.3W, dimmable | 0.2 | 13261 | 6.53 |
| MuShang A60-8W-CA, non-dimmable | 0.1 | 26522 | 1.94 |

Fig. 12A

| LED Light bulb Brand | Number of LED Light Bulbs On the switch circuit | C0 uf | Input power W | Monthly Cost* |
|---|---|---|---|---|
| Candle E12, 15W | 1 | 0.2 | 0.27 | $ 0.03 |
| Sunbeam 9W, 800LM | 1 | 0.1 | 0.13 | $ 0.01 |
| Sunbeam 9W, 800LM | 1 | 0.2 | 0.25 | $ 0.03 |
| Feit Filament 60w, 8.8W | 1 | 0.2 | 0.25 | $ 0.03 |
| Feit Ceiling BR30, 8.3W | 1 | 0.2 | 0.37 | $ 0.04 |
| MuShang A60-8W-CA | 1 | 0.1 | 0.17 | $ 0.02 |
| MuShang A60-8W-CA X4 | 4 | 0.1 | 0.17 | $ 0.02 |
| Feit Ceiling BR30, 8.3W, X3 | 3 | 0.2 | 0.34 | $ 0.04 |
| Feit Ceiling BR30, 8.3W, X3 | 3 | 0.3 | 0.51 | $ 0.06 |
| Feit Ceiling BR30, 8.3W, X3 | 3 | 0.4 | 0.69 | $ 0.07 |
| Candle E12, 15W, X5 | 5 | 0.2 | 0.27 | $ 0.03 |
| Candle E12, 15W, X5 | 5 | 0.3 | 0.41 | $ 0.04 |
| Candle E12, 15W, X5 | 5 | 0.4 | 0.55 | $ 0.06 |

* Based on $0.15/KWH

Fig. 12B

Fig. 12

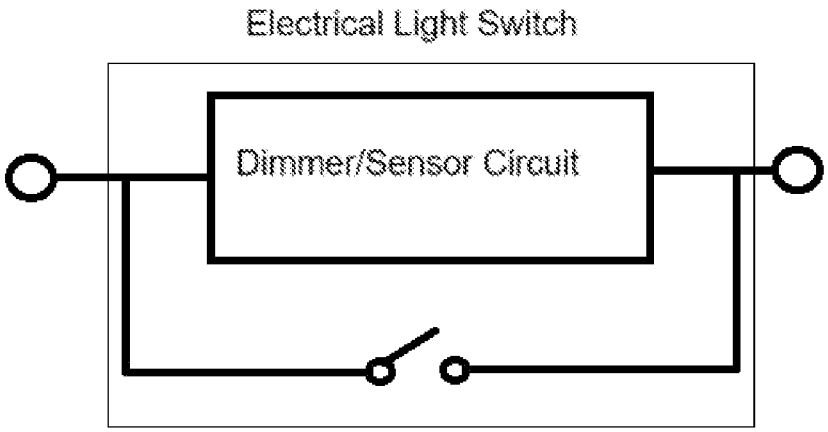
Fig. 13A
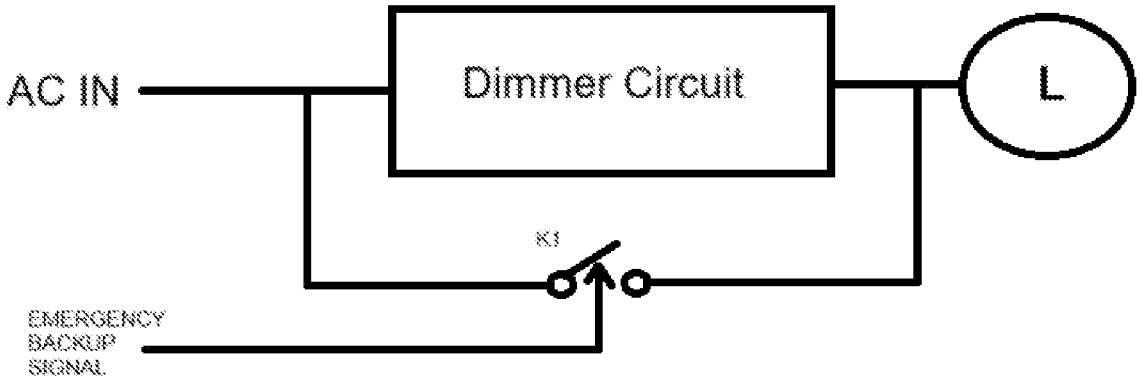
Fig. 13B
Fig. 13

LIGHT DIMMER FOR NON-DIMMABLE LED LIGHT BULBS

RELATED APPLICATIONS

This application claims the benefit of U.S. Provisional Patent Application Ser. No. 63/400,585, filed Aug. 24, 2022, entitled "Light Dimmer for Non-Dimmable LED Light Bulbs" which is hereby incorporated herein by reference in its entirety.

FIELD

This invention relates to electric light dimmer and night lamp devices for LED light bulbs and more particularly, to non-dimmable LED light bulbs.

BACKGROUND

Traditional incandescent light bulb dimmers do not work with LED light bulbs. There are light dimmers in the market which are designed to work specifically with dimmable LED light bulbs and are expensive. These dimmers do not work with less expensive non-dimmable LED light bulbs. Also, they are bulky and consume energy even when they are not in use. Also, there is power loss within the dimmer circuit when in use. Also, PWM (pulse width modulated) based LED light dimmers are said to reduce the LED bulb life because it operates by giving burst of large current pulses which stresses the LED light bulb. U.S. Pat. No. 7,102,902 B1 to Brown, Lodhie, discloses a circuit that supplies specialized load to a conventional Triac based AC dimmer to make traditional light dimmer work with LED light bulb. U.S. Pub. No. US2013/0187623A1 to Harel entitled "Smart Dimming Solution for LED Light Bulb and Other Non-Linear Power Loads" discusses in detail about the disadvantages of using traditional triac based light dimmers for LED light bulbs. The solution per this cited patent is complicated dimmer circuit 302 per FIG. 3 cited in the patent. These dimmers are bulky and expensive. Also, these dimmers would require quiescent power even when not in use to dim the LED light bulbs which results in waste of energy. Also, when the dimmer is in use, there is additional power loss within the switching devices used in these dimmers and results in waste of energy. PWM (pulse width modulated) based LED light dimmers are said to reduce the LED bulb life because it operates by giving burst of large current pulses which stresses the LED light bulb.

SUMMARY

The proposed Invention solves above problems and can be used with Non-Dimmable LED light bulbs and with dimmable LED light bulbs. The proposed dimming method is more energy efficient than traditional dimmers because it uses only capacitors and switches for dimming and does not use any resistive or active components in the dimming circuit like traditional dimmers. The voltage and current across the capacitors are 90 degrees out of phase and therefore there is no power loss across these components. This results in negligible energy loss in the dimmer circuit. Therefore, it does not require bulky heat sinking devices to dissipate the heat generated by large semiconductor power devices used in the traditional bulky light dimmers. Also, there is no waste of energy. The proposed dimmer can extend the LED light bulb life since it operates at lower current levels and does not use PWM (pulse width modulated) based LED light dimmers which are said to reduce the LED bulb life because it operates by giving burst of large current pulses which stresses the LED light bulb.

The proposed dimmer circuit can be built in various configurations. In one embodiment, it can be built as a part of a typical switch wall plate which is on top of the electrical light switch which controls power to the lights in a room in the residential and commercial electrical wiring system. It does not require the replacement of the existing electrical light switch. It can control the brightness of the non-Dimmable or dimmable LED light bulbs.

In another embodiment, it can be built as an Auto Night Light for the whole room with the dimmer circuit as a part of said Electrical switch wall plate which can control either non-Dimmable or dimmable LED light bulbs providing night light at preset level for safety and security at very low energy cost.

Yet, in another embodiment, the dimmer can be built as a round "Dimmer Disc" which can be sandwiched between the LED light bulb and Bulb socket to dim the light bulb at pre-set level. This saves energy and money because the lamp is used at lower wattage level and extends the LED bulb life. For example, a light in the front home porch can be left on for full night at a monthly electricity cost of less than 10 cents per month without worrying about the electric bill (based on 1.5 watts of energy use 12 hours/day with average residential electricity rate in the U.S. of 14.92 per kilowatt-hour in 2022). This also increases security and safety around the property.

BRIEF DESCRIPTION OF THE DRAWINGS:

FIG. 1A depicts the schematic representation of A dimmer circuit for a non-dimmable LED light Bulb or a dimmable LED light bulb connected to mains AC power, consisting of one or more capacitors and a switch network to connect more than one capacitor in an incremental or random order for the purpose of adjusting the LED Light bulb brightness level.

FIG. 1B is like FIG. 1A except, the said switch network is identified as consisting of DIP switches and capacitors connected in a binary number sequence; effective capacitance seen by LED light bulb is dictated by the said DIP switches settings, for the purpose of adjusting the light bulb brightness.

FIG. 1C is a schematic representation of dimmer circuit of FIG. 1B connected to the two terminals of a light switch which powers the LED light bulb connected to the AC power.

FIG. 2A illustrates the dimmer circuit of FIG. 1B installed in the back cavity of the switch wall plate such that DIP switches can be controlled from the front side of the wall plate; two dimmer circuit wires are terminated with locking spade terminals.

FIG. 2B illustrates the details of how to connect each dimmer circuit wire locking spade terminal to the light switch terminal.

FIG. 2C illustrates the typical front view of a rocker style light switch on the wall of a room with wall plate installed prior to dimmer circuit installation.

FIG. 2D depicts the typical front view of rocker style light switch on the wall of a room with a wall plate installed after it is modified with the dimmer circuit and connected to the light switch.

FIG. 3A depicts cross sectional view of the light switch installed inside the junction box inside the wall of a room; also shows the mains AC connection wires to the light bulb and ground wire.

FIG. 3B depicts the cross-sectional view of how the modified switch wall plate with dimmer circuit is connected to the electrical light switch terminals inside the junction box which controls AC power to the LED light bulb.

FIG. 4A depicts the schematic representation of one capacitor dimmer circuit connected to the light switch terminals controlling power to the LED light bulb.

FIG. 4B depicts the encapsulation of the capacitor dimmer circuit and two wires terminated with locking spade terminals.

FIG. 7A illustrates the dimmer circuit and photosensor circuit of FIG. 6 installed in the back cavity of the switch wall plate such that DIP switches can be controlled from the front side of the wall plate and window for photosensor; and the three circuit wires are terminated with locking spade terminals.

FIG. 7B depicts the cross-sectional view of how the modified switch wall plate with dimmer circuit and photosensor circuit wires are connected to the electrical light switch terminals inside the junction box, which controls AC power to the LED light bulb.

FIG. 8A is the schematic representation of dimmer circuit of FIG. 1B with DIP switches built on a round Dimmer Disc with round connecting pads for the said dimmer circuit at the center top and center bottom of the Dimmer Disc.

FIG. 8B illustrates a round Dimmer Disc with center connection pads on top and bottom per the dimmer circuit of FIG. 8A. The dimmer disc is sandwiched between the LED light bulb and the socket for the purpose of dimming an LED light bulb.

FIG. 9A depicts the top view of Dimmer Disc with dimmer circuit of FIG. 8A.

FIG. 9B depicts cross sectional view of Dimmer Disc with dimmer circuit of FIG. 8A showing top and bottom pad connections; a donut shaped double sided foam tape attached to the bottom side of Dimmer Disc.

FIG. 9C depicts the bottom view of Dimmer Disc with donut shaped foam tape.

FIG. 9D illustrates Dimmer Disc with dimmer circuit of FIG. 8A is attached to the LED light bulb base utilizing donut shaped double sided foam tape.

FIG. 10A illustrates the use of pan head screws as an alternate solution to using DIP switches on Dimmer Disc for connecting circuits.

FIG. 10B shows magnified detail of FIG. 10A as to how one of the screws connects the circuit traces on Dimmer Disc.

FIG. 10C illustrates the use of twist-on wire connectors for connecting dimmer circuit wires to the light switch terminals inside the junction box.

FIG. 11 shows the table for the actual measured data and corresponding chart showing the light brightness and power input of non-dimmable LED light bulb for all 16 combinations of 4-bit DIP switches settings.

FIG. 12A shows table of the measured data indicating minimum start-up current for various brands dimmable and non-dimmable LED light bulbs.

FIG. 12B shows table indicating the power consumed and corresponding monthly utility cost for operating various brand LED light bulbs at low brightness continuously.

FIG. 13A illustrates a light switch with integrated dimmer/sensor circuit.

FIG. 13B illustrates a method to use dimmer for saving energy when emergency power kicks in.

DETAILED DESCRIPTION

Figure 5:
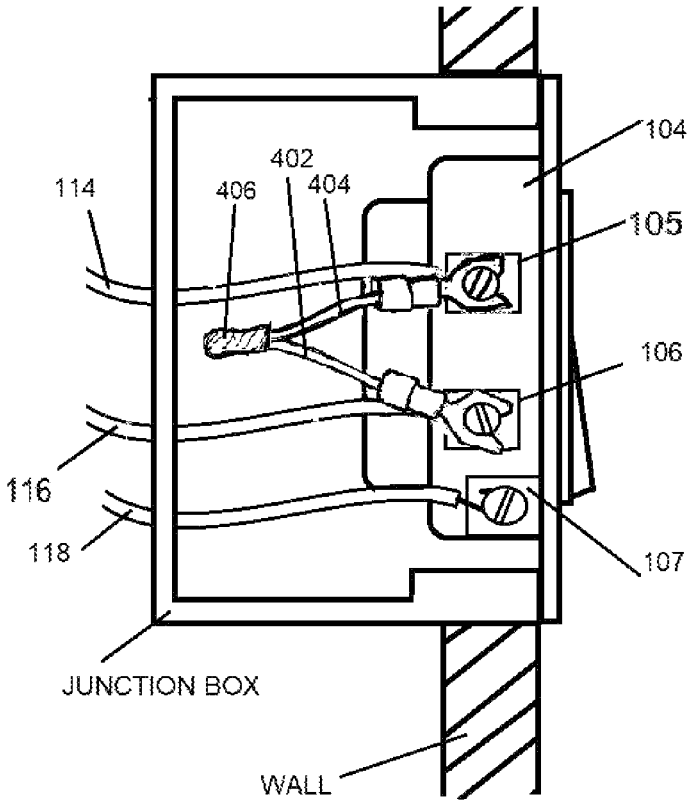
FIG. 5 depicts the cross-sectional view showing how one capacitor dimmer circuit wire terminals are connected to the light switch terminals inside the junction box.

Certain embodiments as disclosed herein provide for light dimmer or night light for non-dimmable and dimmable LED light bulbs. After reading this description it will become apparent how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the claims.

FIG. 1A is a schematic representation of a dimmer circuit for a non-dimmable LED light bulb or a dimmable LED light bulb 102 (or more than one LED light bulbs of the same type and model connected in parallel) connected to an alternating current mains power 120. The dimmer circuit comprises of one or more non-polarized capacitors C1 through Cn with one side of the terminals connected together as Common and other side of terminals connected to a switch network 100 capable to connect said capacitors in an incremental or random order producing net capacitance at the output C0. The switch network 100 can be made of mechanical switches or semiconductor switches. This write-up will focus on the use of mechanical switches. This dimmer circuit would not have been practical for use with incandescent light bulbs because of the high current requirements to operate incandescent light bulbs. However, with the advent of LED light bulbs, this dimmer circuit is practical because of very low current requirements to operate a non-dimmable or dimmable LED light bulb. Since the internal LED bulb circuitry is proprietary to each different brand, bench testing was conducted, and it showed that some LED bulb brands (mostly non-dimmable) were found to start operating under 2 ma and some brands (mostly dimmable type) would require over 5 ma before they start operating. With C0 value of 0.1 uf, the impedance of the dimmer circuit (assuming 120V mains line frequency of 60 Hz) would be $Xc=1/(2\pi fc)=26522$ ohms. Therefore, the maximum current available to the LED bulb would be 120V/26522=4.5 ma, assuming the LED bulb is short. However, actual current will depend on the internal circuit structure of a specific LED bulb brand. FIG. 12A shows the test data of some brands of LED bulbs using the said dimmer circuit with C0 equivalent of 0.1 uf or 0.2 uf as required to light up the LED light bulb. FIG. 12A is not meant to include an exhaustive list of brands that would work with this dimmer circuit. There were more dimmable LED bulb brands tested, however, the test data are not included since the focus was on non-dimmable LED light bulbs. In general, all the brands available at the time of testing worked with this dimmer circuit. It was noted that you can have more than one LED light bulb of the same type and model connected in parallel on the same circuit and the dimmer circuit works fine except the brightness is distributed between the number of LED light bulbs used in the same circuit.

FIG. 1B is a dimmer circuit per FIG. A, except switch network 100 consisting of 4-bit DIP switches 110 (four SPST switches ganged together) with one side of terminals connected to other terminals of capacitors C1-C15 in a binary weighted manner as shown. The other side of terminals of DIP switch 110 are tied together labeled as Output capacitor C0. The effective capacitance C0 seen by the LED light bulb will depend on the setting of four DIP switches in the range of 0 (with all DIP switches Off) to 1.5 uf (with all switches On). FIG. 11 table 1 shows all combinations of DIP switches settings and corresponding value of capacitor CO as seen by the LED light bulb, bulb brightness and input power. It also shows the chart of the LED bulb brightness Vs. Capacitance indicating that the brightness of the LED light bulb increases almost linearly. Similarly with the use of 8-bit DIP switches and 255 capacitors, 255 different LED bulb brightness can be obtained and so on. By changing the value of each capacitor from 0.1 uf to 0.2 uf, the brightness range will double and so on. This dimmer circuit has dual functionality. It can be used as a light dimmer or as a night lamp when used with low value capacitors.

In one embodiment per FIG. 1C, dimmer circuit 112 is connected to an existing light switch 104 circuit which controls non-dimmable LED light bulb 102. FIG. 1C is the schematic representation showing how the said dimmer circuit 112 is connected to an existing light switch 104 which controls non-dimmable LED light bulb 102. When the light switch 104 is in the ON position, LED light bulb 102 would be fully on. When the light switch 104 is in the OFF position and all of four DIP switches 110 are in OFF position, then LED light bulb 102 will be fully OFF. If any of the DIP switches are ON, then some current will flow through the non-dimmable LED light bulb 102 and resulting in non-dimmable LED light bulb 102 to glow with the brightness as shown in FIG. 11.

Now let us discuss how to implement the above dimmer circuit with a light switch in a room in a house.

FIG. 2C illustrates a typical rocker style light switch 104 with a wall plate 201 on the wall of a room. FIG. 3A depicts a cross section view of light switch 104 installed inside a junction box in the wall. It shows three electrical wires 114(From light bulb), 116(Hot) and 118(Ground) entering the junction box and connected to the light switch terminals 105,106, and 107 respectively per FIG. 1C schematic. Dimmer circuit 112 is installed in the back cavity of a wall plate 201 per FIG. 2A with DIP switch 110 body protruding in the front side of the wall plate for access to the switch controls. Also, two terminating wires 108 and 109 with locking type spade terminals looking like 108A (only one labeled for simplicity) are connected to the dimmer circuit 112 terminals Ccom and C0 respectively. Other ends of these two wires 108 and 109 with locking type spade terminals are connected to the light switch 104 terminals 106 and 105 respectively inside the junction box per FIG. 3B. FIG. 3B illustrates the cross-section view of wall plate 201 with dimmer circuit 112 attached, DIP switch protruding the wall plate, wires 108 and 109 connected to light switch 104 terminals 105 and 106 inside the junction box. FIG. 2B illustrates the magnified view showing the proper method to connect the locking type spade terminal to switch terminal; 114 is the existing light switch wire with loop 114A on terminal 105; After the terminal screw 105A is loosened, locking type spade terminal 108A can be clicked on under the screw head 105A; Spade terminal 108A acts as a washer over the wire loop 114A and screw can be tightened for a secured connection (this is the only place in this document where the use of locking type spade terminal 108A and terminal screw 105A is discussed in detail. For simplicity, assume same applies to other places where locking type spade terminals are used). After all the connections are completed, switch 104 and wall plate 201 are secured back to the wall with the finished view of FIG. 2D. With the switch 104 in the OFF position, LED light bulb brightness can be controlled by DIP switches 110 per FIG. 11. For full brightness, the switch can be turned to ON position.

Some living spaces without windows may be completely dark without lights. For example, restrooms, closets, basement etc. In this situation, it would be beneficial to have some dim light all the time in the room for safety and security without worrying about the electric bill. Consider the dimmer circuit of FIG. 1A with only one capacitor or more than one capacitor connected in parallel. In either case C0 will be the net capacitance seen by the LED light bulb 102. In this embodiment per FIG. 4A, a dimmer circuit consisting of a fixed value capacitor C0 is connected across light switch 104 terminals 105 and 106. FIG. 4B illustrates encapsulated C0 as 406 connected to two wires 402 and 404 terminated with locking type spade terminals. FIG. 5 depicts cross sectional view of light switch 104 inside the junction box with wires 402 and 404 connected to light switch terminals 106 and 105 respectively (although the order does not matter). When the light switch 104 is in the OFF position, there will be some current flowing through the LED light bulb and it will glow at dim level sufficient to see in the dark, depending on the value of CO and brand of light bulb 102, with monthly electric cost in the range of $0.01 to $0.07 based on average USA utility rate of $0.15 per KWH. Please see FIG. 12B table for the monthly electrical cost associated with various brands and brightness level depending on the value of C0. Please note that you can have more than one LED light bulb on the same switch circuit and the dimmer circuit works fine except the current is distributed to the number of LED light bulbs used in the same switch circuit.

Figure 6:
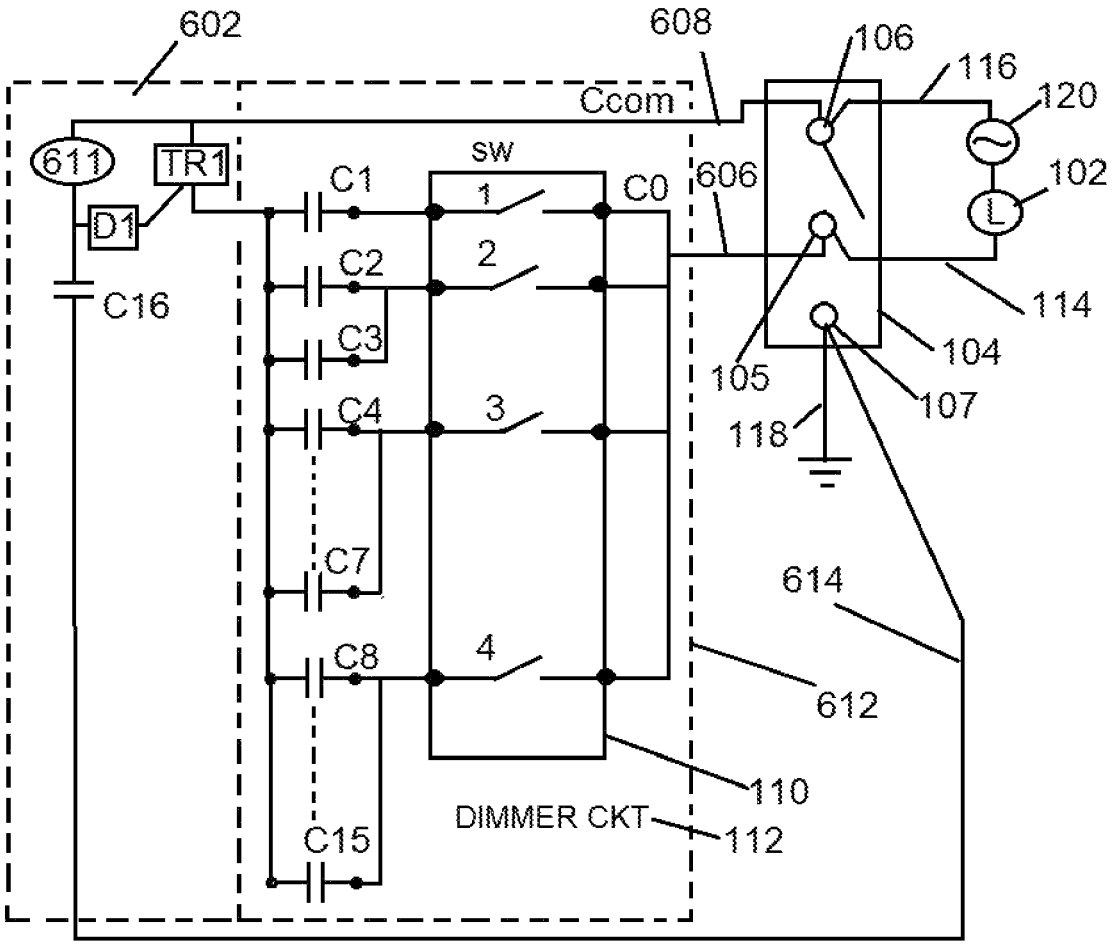
FIG. 6 depicts the schematic representation of dimmer circuit of FIG. 1B with added photosensor circuit switch wherein photosensor turns on Triac switch in the absence of ambient light to enable auto night light function at preset brightness level.

Yet, in another embodiment per FIG. 6, photosensor circuit 602 is added to the dimmer circuit 112 to enable LED light bulb 102 to turn on automatically at preset dimming level set by DIP switches 110 in the absence of ambient light. Any room in the house can be lit with a predetermined light when dark automatically. This would replace tiny night lamps plugged in the electrical outlets and provide much more enhanced ambient light for the whole room at very low electric cost. This also adds safety and security around any living space. Photo sensor circuit comprises of LDR (light dependent resistor) 611, Diac D1, capacitor C16 and Triac switch TR1. You need quiescent current to make the sensor circuit work which is provided through capacitor C16 connected to ground terminal 107 of the switch. The ground current is kept well below the allowable limit of Typically, GFCI (Ground Fault Circuit Interrupter) trips at 5 ma. Dimmer circuit 112 common Ccom is connected through Triac TR1 to AC mains power 116. Therefore, the dimmer circuit is activated only after TR1 switch is turned on. TR1 is activated to turn on only at certain ambient light thresholds determined by LDR 611. As shown in FIG. 6, this Dimmer/photosensor circuit 612 has three wires termination. Wires 606 and 608 are connected across the light switch 104 power terminals 105 and 106 respectively. Third Wire 614 which provides path for quiescent current to the photosensor circuit 602 is connected to the ground terminal 107 of the light switch 104 (it can also be connected to any ground inside the junction box). FIG. 7A shows the implementation of photosensor/dimmer circuit 612. It is installed inside the back cavity of wall plate 201. DIP switch 110 controls are accessible from the front side of wall plate 201. There is a small window in the front of LDR 611 location for detection of ambient light. Three wires 606, 608 and 614 are terminated with locking type spade terminals as shown. FIG. 7B depicts the cross-sectional view showing how the three wires 606, 608 and 614 from the photosensor/dimmer circuit 612 installed inside the wall plate 201 are connected to the light switch 104 terminal 106, 105 and 107 respectively inside the junction box (wire 614 can also be connected to any ground inside the junction box). For the proper method to connect each locking type spade terminal to the switch terminal, please refer to FIG. 2B.

Typically LED light bulbs are advertised to last for 10,000 to 15,000 hours depending on the brand. The life of the LED light bulb can be increased significantly if used at a lower wattage level than at rated level. This would save energy costs and bulb replacement costs. This would also enhance the safety and security of the consumer, for example leaving the lights on overnight every day in the front yard and back yard of the house without worrying about the electricity bill. This brings to yet another embodiment of the dimmer circuit 112 per FIG. 8A and FIG. 8B. FIG. 8A is the schematic representation of dimmer circuit 112 built on a round disc shaped substrate "Dimmer Disc" 812 with circular connecting circuit pads 807 and 815 in the center top and center bottom of the Dimmer Disc 812. The outsize diameter of the Dimmer Disc 812 is selected slightly smaller than the LED light bulb 802 base 804 diameter for the easy insertion inside the bulb socket 810. FIG. 8B illustrates the idea of sandwiching the Dimmer Disk 812 between the LED light bulb 802 and the bulb socket 810 as shown which is powered by mains AC source (not shown). The settings on DIP switches 110 not only control the LED light bulb 802 brightness, but it will also control the LED light bulb 802 wattage. FIG. 9 illustrates how to make the idea of FIG. 8B practical. FIG. 9A is the top view of Dimmer Disc 812. Circuit layout is important to keep central area around pad 815 and 807 clear of any components. A very small footprint DIP switch 110 is used. C1-C15 are also very small footprints with high voltage ratings. FIG. 9B depicts the side view of the Dimmer Disc 812 with double sided donut shaped foam tape attached to the bottom. FIG. 9C is the bottom view of the Dimmer Disc 812 with foam tape 902. Notice a big clearance hole in the center of the foam tape 902 for clear access to pad 807. FIG. 9D illustrates how the Dimmer Disc 812 is attached to the LED light bulb 802 base 804 with double sided foam tape 902. Now the LED light bulb 802 with Dimmer Disc 812 is ready to be screwed into the bulb socket 810 or screwed out in any orientation.

FIG. 10A illustrates an idea of using panhead micro screws S1-S4 in place of using 4-bit DIP switch 110 on Dimmer Disc 812. FIG. 10B shows in magnified detail, how to make circuit connection from circuit pad 1003 to circuit pad 1002 using pan head micro screw S1-S4 on the Dimmer Disc 812. When the screw is up, the circuit connection from circuit pad 1002 to 1003 is open and when the screw is down and tight, the circuit connection from circuit pad 1002 to 1003 is closed. This was implemented in some prototypes, and it works fine.

FIG. 10C illustrates alternate method to connect wires 108 and 109 from dimmer circuit 112 to the light switch 104 terminals 105 and 106 respectively when use of locking type spade terminals is not allowed by local wiring codes. In this case, electrical wires 114 and 116 in the junction box originally connected to the light switch 104 terminals 105 and 106 are cut at the place twist-on connectors are to be used. Now these small cut wires at the terminals 105 and 106 are labeled as 1015 and 1014 respectively. Now wires 108, 114 and 1015 can be connected using twist-on connector 1013. Similarly wires 109, 116 and 1014 can be connected using twist-on connector 1012.

FIG. 13A illustrates AC light switch with integrated dimmer circuit and sensor circuit. Replacing the existing light switch with this light switch can benefit from this invention.

FIG. 13B illustrates a method to utilize dimmer circuit for saving energy when emergency power kicks in. Normally AC power is connected to the LED lamp loads directly with K1 relay contacts in closed position. When Emergency power kicks in, relay K1 relay contacts are in open position forcing AC power go through the dimmer circuit and LED light bulbs operate at lower power level to enable the emergency secondary power to last longer.

I claim:

1. A dimmer circuit for non-dimmable LED light bulb comprising of one or more non-polarized capacitors with one terminal of all capacitors connected together as a common, and other terminals of the said capacitors are connected to a switch network which can connect these terminals selectively to create net capacitance value C0; connected in series with non-dimmable LED light Bulb, powered by AC mains for the purpose of adjusting the LED Light bulb brightness level by adjusting the value of C0.

2. Dimmer circuit per claim one with more than one non-dimmable LED light bulbs of the same type and model connected in parallel.

3. Dimmer circuit per claim one with one or more dimmable LED light bulbs of same type and model connected in parallel.

4. The dimmer circuit of claim 1, wherein the said switch network consisting of DIP switches and capacitors connected in a binary weighted manner; effective capacitance C0 seen by LED light bulbs is dictated by the said DIP switches settings (for example 4-bit DIP switch can produce 16 distinct C0 values), for the purpose of adjusting the LED Light bulb brightness incrementally or randomly.

5. The dimmer circuit of claim 4, installed inside a light switch wall plate cavity with the dimmer circuit wires terminated with locking type spade terminals, connected to light switch terminals which control the power to one or more LED light bulbs of the same type and model, adjusting the light bulb brightness by changing the DIP switch settings, when the light switch is in OFF position.

6. The dimmer circuit of claim 4, installed inside a light switch wall plate cavity with the dimmer circuit output wires with stripped ends, connected to light switch terminal wires using twist-on wire connectors, which control the power to one or more LED light bulbs of same type and model, adjusting the light bulb brightness by changing the DIP switch settings, when light switch is in OFF position.

7. The dimmer circuit of claim 1, wherein the said switch network consisting of one or more than one capacitors connected in parallel to form a single high value capacitor C0, circuit wires terminated with locking type spade terminals and connected across light switch terminals which control the power to one or more LED light bulbs of same type and model, for the purpose of obtaining fixed LED Light bulb brightness when the light switch is in the OFF position.

8. The dimmer circuit of claim 1, wherein the said switch network consisting of one or more than one capacitors connected in parallel to form a single high value capacitor C0, circuit wires connected to light switch terminal wires using twist-on wire connectors, which control the power to one or more LED light bulbs of same type and model, for the purpose of obtaining fixed Light bulb brightness when the light switch is in the OFF position.

9. The dimmer circuit of claim 4, with added photosensor circuit wherein photosensor turns on Triac switch connected in series with the dimmer circuit, in the absence of ambient light to enable auto night light function at preset brightness level set by DIP switches, a third wire from photosensor circuit connected to the ground terminal of the light switch provides quiescent current for the photosensor circuit operation, quiescent current staying within the limit of allowable ground current per the local electrical codes.

10. The dimmer circuit of claim 4, built on a round disk shaped substrate "Dimmer Disc" with circular connecting circuit pads for the said dimmer circuit at the center top and center bottom of the Dimmer Disc; the outside disc diameter matching to the LED light bulb base for easy insertion in the bulb socket; Dimmer Disc attached to the light bulb base using donut shaped double sided foam tape; when the LED light bulb screwed in the bulb socket connected to mains, current passes through the said dimmer circuit to the LED light bulb when the said center top pad of the Dimmer Disc touches the central terminal of the LED light bulb base and the said center bottom pad of the Dimmer Disc touches the central terminal of the socket; for the purpose of controlling brightness level or reduced wattage use of individual non dimmable or dimmable LED light bulb as set by the DIP switches setting.

11. The dimmer circuit of claim 1, automatically engaging in series with the LED lamp loads of same type and model to conserve energy, when emergency power kicks in.

12. The circuit of claim 9 integrated within a light switch.

13. A light switch integrated with the dimmer circuit of claim 1.

14. A method to replace a SPST electrical switch used on a substrate, by using pan head screw which connects circuit traces on the substrate under the head of the screw, when screw is up and loose the circuit is open, when the screw is down and tight, the circuit traces are connected to simulate switching action.

* * * * *